US011293683B2

(12) United States Patent
Hsieh et al.

(10) Patent No.: US 11,293,683 B2
(45) Date of Patent: Apr. 5, 2022

(54) DEFOGGING CONTROL SYSTEM AND METHOD

(71) Applicant: TECO Electric & Machinery Co., Ltd., Taipei (TW)

(72) Inventors: Po-Yao Hsieh, Taipei (TW); Chih-Hung Hsiao, Taipei (TW); Ifan Sun, Taipei (TW)

(73) Assignee: TECO ELECTRIC & MACHINERY CO., LTD., Taipei (TW)

( * ) Notice: Subject to any disclaimer, the term of this patent is extended or adjusted under 35 U.S.C. 154(b) by 163 days.

(21) Appl. No.: 16/665,402

(22) Filed: Oct. 28, 2019

(65) Prior Publication Data

US 2021/0063076 A1 Mar. 4, 2021

(30) Foreign Application Priority Data

Aug. 26, 2019 (TW) ..... 108130414

(51) Int. Cl.

| | |
|---|---|
| ***F25B 49/02*** | (2006.01) |
| ***F25D 23/02*** | (2006.01) |
| ***F25D 21/00*** | (2006.01) |
| ***F25D 21/04*** | (2006.01) |
| ***F25D 21/08*** | (2006.01) |
| ***F25B 47/02*** | (2006.01) |
| ***A47F 3/04*** | (2006.01) |

(52) U.S. Cl.

CPC ..... *F25D 21/008* (2013.01); *A47F 3/0434* (2013.01); *F25B 47/02* (2013.01); *F25D 21/04* (2013.01); *F25D 21/08* (2013.01); *F25D 2600/02* (2013.01); *F25D 2700/02* (2013.01); *F25D 2700/14* (2013.01)

(58) Field of Classification Search

CPC ..... F25D 21/008; F25D 21/04; F25D 21/08

See application file for complete search history.

(56) References Cited

U.S. PATENT DOCUMENTS

| | | | | |
|---|---|---|---|---|
| 4,327,557 A * | 5/1982 | Clarke | F25D 21/006 | 62/153 |
| 8,539,783 B1 * | 9/2013 | Bunch | A47F 3/0482 | 62/154 |
| 2005/0229614 A1 * | 10/2005 | Ansted | F25D 29/00 | 62/150 |
| 2008/0141689 A1 * | 6/2008 | Sunderland | A47F 3/0434 | 62/151 |

(Continued)

*Primary Examiner* — Christopher R Zerphey
*Assistant Examiner* — Bejeir Brooks
(74) *Attorney, Agent, or Firm* — Muncy, Geissler, Olds & Lowe, P.C.

(57) ABSTRACT

A defogging control system includes a plurality of first heating wires, a plurality of second heating wires, an electrical sensor and driver, a timer, an environment sensing module, and a control module. The electrical sensor and driver is utilized to generate a start signal or a stop signal, corresponding to a controller of a refrigeration storage apparatus. The timer is utilized to count a real-time operation time and record a previous operation time. The environment sensing module is utilized to sense a temperature and a humidity. The control module is utilized to control the first heating wires and the second heating wires by the real-time operation time, the previous operation time, the temperature, and the humidity. Further, a defogging control method is also provided.

10 Claims, 8 Drawing Sheets

(56) References Cited

U.S. PATENT DOCUMENTS

| | | | | |
|---|---|---|---|---|
| 2010/0083672 | A1* | 4/2010 | Yoon | F25D 21/002 62/85 |
| 2015/0285551 | A1* | 10/2015 | Aiken | A47F 3/0478 62/80 |
| 2021/0063076 | A1* | 3/2021 | Hsieh | F25D 21/008 |

* cited by examiner

DEFOGGING CONTROL SYSTEM AND METHOD

This application claims the benefit of Taiwan Patent Application Serial No. 108130414, filed on Aug. 26, 2019, the subject matter of which is incorporated herein by reference.

BACKGROUND OF THE INVENTION

(1) Field of the Invention

The invention relates to a system and method, and more particularly to a defogging control system and method.

(2) Description of the Prior Art

Refrigeration equipment such as a refrigerator, a freezer or a refrigeration chamber is known as one of necessary appliances to ordinary family and many industries. Generally speaking, in order to prevent vapor water, steam or moisture from being condensed on the refrigeration equipment, some electric heating wires are usually introduced to particular surfaces of the refrigeration equipment. In the art, the electric heating wire is usually operated all the day, particularly to the refrigeration equipment for business purposes. This kind of refrigeration equipment usually has a transparent glass for customers to see through. To avoid possible condensing of water on the transparent glass (from which the customers may not be easy to see products behind the glass), thus the electric heating wire would be operated 24 hours a day. In general, the electric heating wire would consume 30%-40% of total electricity for the refrigeration equipment. Since the rate of electricity for business is high, thus it is worth in the art to develop a control system for the electric heating wire according to environmental differences across the transparent glass of the refrigeration equipment.

SUMMARY OF THE INVENTION

In view that the 24-hour operation of the conventional electric heating wires would cost excessive energy and money, accordingly it is an object of the present invention to provide a defogging control system and method that can resolve at least one of the aforesaid shortcomings in conventional design.

In the present invention, the defogging control system is disposed at a refrigeration storage apparatus having a controller, a compressor, a main casing and a door. The defogging control system includes a plurality of first heating wires, a plurality of second heating wires, an electrical sensor and driver, a timer, an environment sensing module and a control module.

The first heating wires are disposed on the main casing by facing the door. The second heating wires are disposed on the main casing by facing the door and located with respect to the first heating wires. The electrical sensor and driver, electrically coupled with the controller and the compressor, is used for detecting a control signal generated by the controller, for generating a start signal to activate the compressor upon when the control signal is determined to be a high voltage signal, for generating a stop signal to deactivate the compressor upon when the control signal is determined to be a low voltage signal. The timer, electrically coupled with the electrical sensor and driver, is used for detecting a real-time operation time of the compressor upon when the start signal is received, and for recording a preceding operation time of the compressor. The environment sensing module is used for detecting an ambient temperature and an ambient humidity.

The control module, electrically coupled with the environment sensing module, the electrical sensor and driver and the timer, is used for receiving the ambient temperature, the ambient humidity, the real-time operation time and the preceding operation time, for controlling respectively each of the plurality of first heating wires to activate at a first power since a first working time start point and each of the plurality of second heating wires to activate at a second power since a second working time start point upon when the start signal is received, so that the refrigeration storage apparatus is prevented from moisture condensation. The first power is greater than the second power. When the control module receives the stop signal, the plurality of first heating wires and the plurality of second heating wires are deactivated.

In one embodiment of the present invention, the control module includes a first control unit. The first control unit defines a product of the ambient humidity and the preceding operation time to be a first working time, calculates a first time difference between the preceding operation time and the first working time, and defines the first working time start point for activating the plurality of first heating wires upon when the real-time operation time is determined to be greater than the first time difference.

In one embodiment of the present invention, when the first control unit receives the stop signal, each of the plurality of first heating wires is deactivated.

In one embodiment of the present invention, the control module includes a second control unit; wherein the second control unit evaluates the ambient temperature and the ambient humidity to calculate a dew point temperature, derives a temperature difference between the ambient temperature and the dew point temperature, and defines the second working time start point for activating the plurality of second heating wires upon when an absolute value of the temperature difference is determined to be smaller than a threshold value.

In one embodiment of the present invention, the second control unit defines a product of the ambient humidity and the preceding operation time to be a second working time, calculates a second time difference between the preceding operation time and the second working time, and defines the second working time start point for activating the plurality of second heating wires upon when the absolute value of the temperature difference is greater than or equal to the threshold value and the real-time operation time is greater than the second time difference.

In one embodiment of the present invention, when the second control unit receives the stop signal, each of the plurality of second heating wires is deactivated.

In one embodiment of the present invention, each of the plurality of first heating wires extends vertically by being embedded in the main casing, and each of the plurality of second heating wires extends horizontally by being embedded in the main casing.

In one embodiment of the present invention, each of the plurality of first heating wires has a first length, each of the plurality of second heating wires has a second length, and the first length is greater than the second length.

In one embodiment of the present invention, the main casing has a plurality of longer sides and a plurality of shorter sides, each of the plurality of first heating wires extends along one of the plurality of longer sides, and each of the plurality of second heating wires extends along one of the plurality of shorter sides.

In the present invention, the defogging control method, applied to the defogging control system, includes the steps of: (a) upon when the control signal is determined to be the high voltage signal, utilizing the electrical sensor and driver to generate the start signal for activating the compressor; (b) upon when the start signal is received, utilizing the timer to detect the real-time operation time of the compressor and to record the preceding operation time of the compressor, and utilizing the environment sensing module to detect the ambient temperature and the ambient humidity; and, (c) upon when the start signal is received, utilizing the control module to evaluate the ambient temperature, the ambient humidity, the real-time operation time and the preceding operation time to respectively control each of the plurality of first heating wires to activate at the first power since the first working time start point and each of the plurality of second heating wires to activate at the second power smaller than the first power since the second working time start point; and, upon when the stop signal is received, each of the plurality of first heating wires and the plurality of second heating wires is deactivated.

In one embodiment of the present invention, the Step (c) further includes the steps of: (c1) utilizing a first control unit of the control module to define a product of the ambient humidity and the preceding operation time to be a first working time, and to calculate a first time difference between the preceding operation time and the first working time; (c2) upon when the real-time operation time is greater than the first time difference, utilizing the first control unit to define the first working time start point for activating the plurality of first heating wires; and, (c3) upon the stop signal is received, utilizing the first control unit to deactivate the plurality of first heating wires.

In one embodiment of the present invention, the Step (c) further includes the steps of: (c4) utilizing a second control unit of the control module to evaluate the ambient temperature and the ambient humidity to calculate a dew point temperature, and to compute a temperature difference between the ambient temperature and the dew point temperature; (c5) utilizing the second control unit to determine whether or not an absolute value of the temperature difference is smaller than a threshold value; (c6) if a determination of the Step (c5) is positive, utilizing the second control unit to define the second working time start point for activating the plurality of second heating wires; (c7) if the determination of the Step (c5) is negative, utilizing the second control unit to define a product of the ambient humidity and the preceding operation time to be a second working time, and to calculate a second time difference between the preceding operation time and the second working time; (c8) upon when the real-time operation time is determined to be greater than the second time difference, utilizing the second control unit to define the second working time start point for activating the plurality of second heating wires; and, (c9) after one of the Step (c6) and the Step (c8), upon when the stop signal is received, utilizing the second control unit to deactivate the plurality of second heating wires.

As stated, the defogging control system and method provided by the present invention utilizes the first heating wires, the second heating wires with different powers to the first heating wires, operation states of the compressor, the ambient temperature and the ambient humidity as variables to control ON/OFF of the first heating wires and the second heating wires. In comparison with the prior art, the system and method provided by the present invention can save the electric energy and also prevent the refrigeration storage apparatus from moisture condensation.

All these objects are achieved by the defogging control system and method described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to a defogging control system and method. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
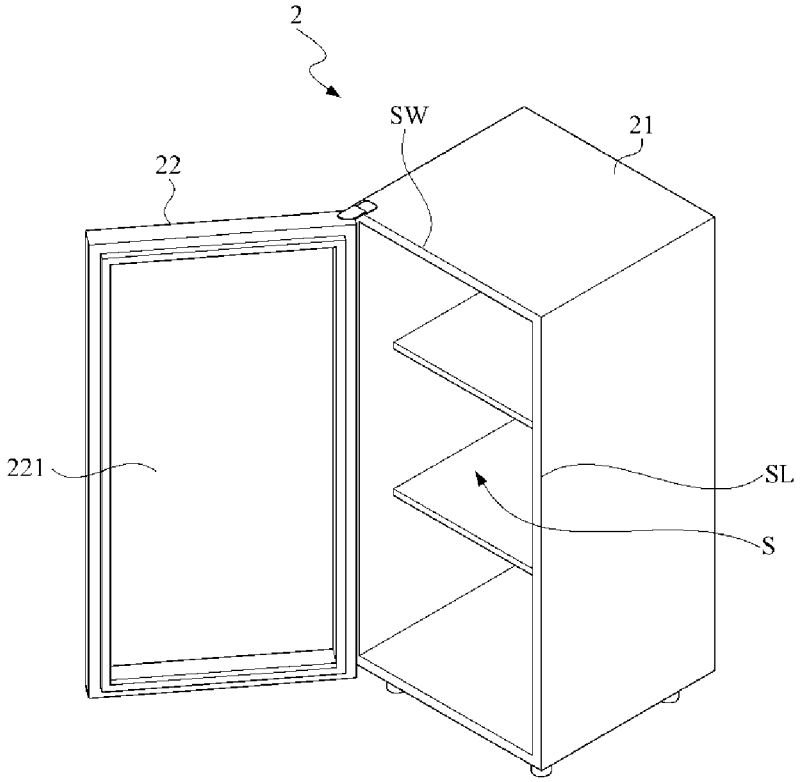
FIG. 1 is a schematic perspective view of a refrigeration storage apparatus applying a preferred embodiment of the defogging control system in accordance with the present invention.
Figure 2:
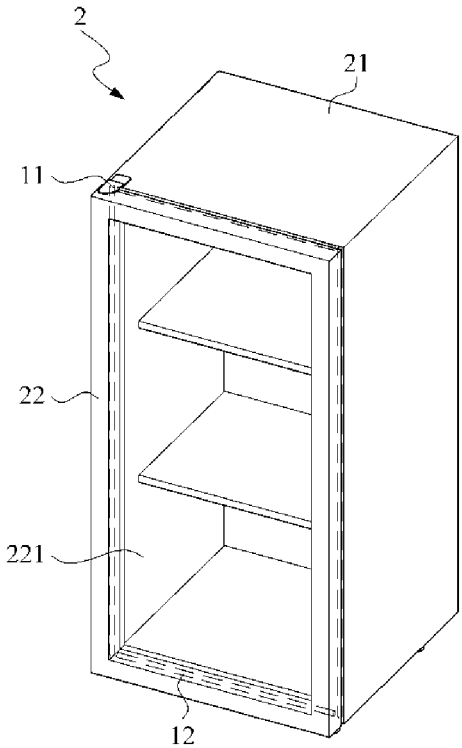
FIG. 2 is another perspective view of FIG. 1 with the door closed.
Figure 3:
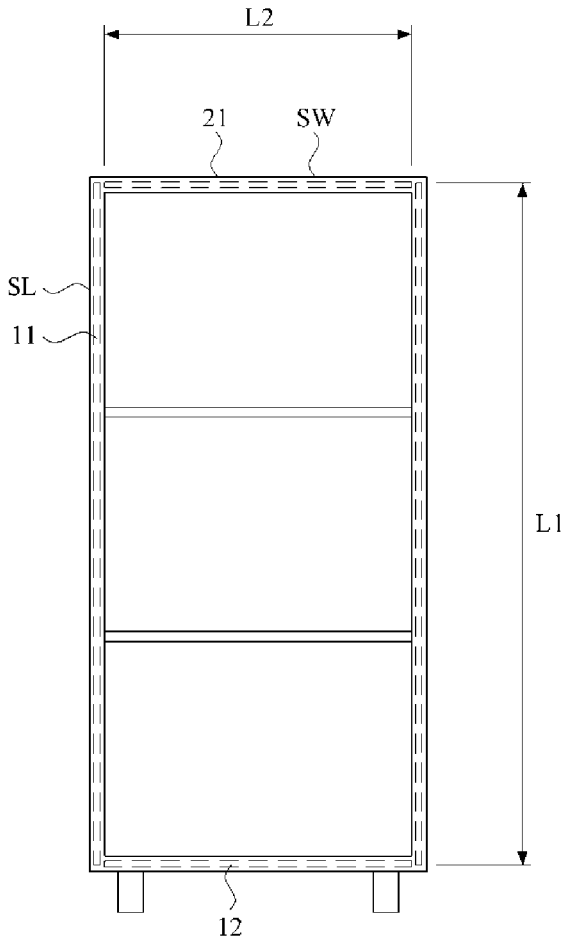
FIG. 3 is a schematic front view of FIG. 1 with the door removed.
Figure 4:
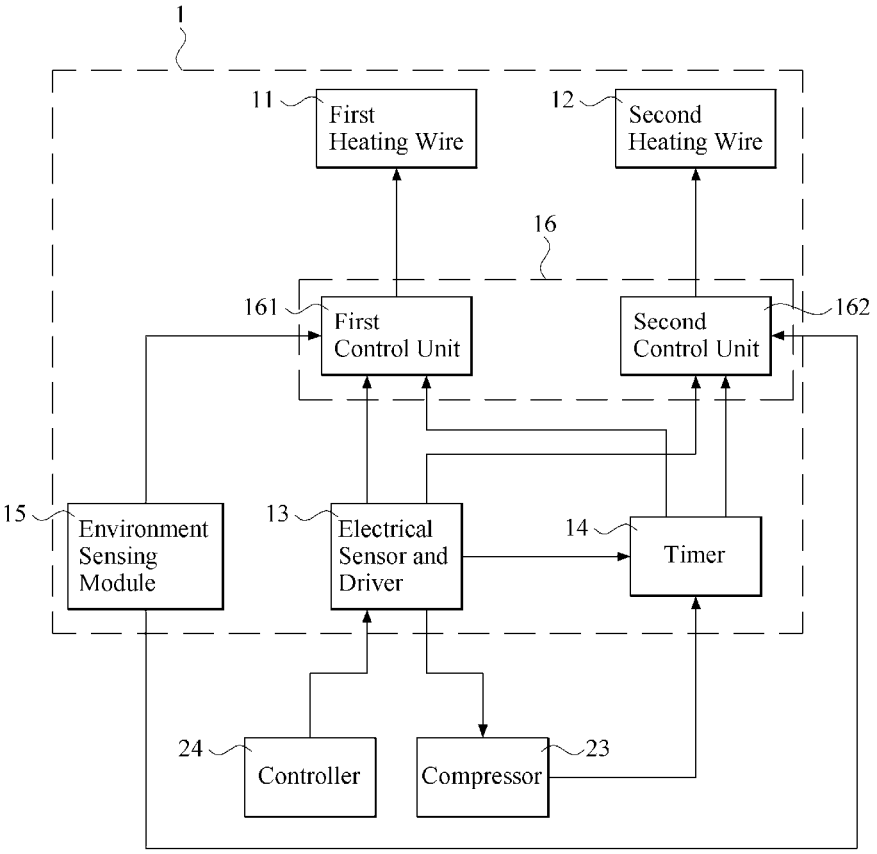
FIG. 4 is a schematic block view of the preferred embodiment of the defogging control system in accordance with the present invention.

Refer now to FIG. 1 through FIG. 4; where FIG. 1 is a schematic perspective view of a refrigeration storage apparatus applying a preferred embodiment of the defogging control system in accordance with the present invention, FIG. 2 is another perspective view of FIG. 1 with the door closed, FIG. 3 is a schematic front view of FIG. 1 with the door removed, and FIG. 4 is a schematic block view of the preferred embodiment of the defogging control system in accordance with the present invention. As shown, the defogging control system 1 is disposed at the refrigeration storage apparatus 2.

The refrigeration storage apparatus 2 includes a main casing 21, a door 22, a compressor 23 and a controller 24. The main casing 21 defines thereinside a storage space S, and the door 22 for pairing the main casing 21 is furnished with a transparent glass 221 for outside people to see the inside storage space S through the transparent glass 221. In other words, while the door 22 closes the main casing 21, any customer can see clearly objects or products arranged inside the storage space S through the transparent glass 221. In addition, with respect to the door 22, the main casing 21 is further defined to have a plurality of longer sides SL (two shown in the figure) and a plurality of shorter sides SW (two shown in the figure).

The defogging control system 1 includes a plurality of first heating wires 11 (two shown, but only one labeled, in the figure), a plurality of second heating wires 12 (two shown, but only one labeled, in the figure), an electrical sensor and driver 13, a timer 14, an environment sensing module 15 and a control module 16.

The first heating wire 11 is disposed along the longer side SL of the main casing 21 by facing the door 22, preferably by being embedded in the main casing 21. On the other hand, the second heating wire 12, respective to the first heating wire 11 is disposed along the shorter side SW of the main casing 21 by also facing the door 22, preferably by being embedded in the main casing 21. Particularly, a first length L1 of the first heating wire 11 is larger than a second length L2 of the second heating wire 12.

In this embodiment, the first heating wire 11 extends vertically, and the second heating wire 12 extends horizontally. However, in some other embodiments, the heating wires 11, 12 may be arranged relevantly per requirements. In particular, the determination of arranging the heating wires 11, 12 may depend on the locations of the longer side SL and the shorter side SW of the door 22. In a situation that the longer side SL of the door 22 extends horizontally, and the shorter side SW thereof extends vertically, then the first heating wire 11 would be disposed horizontally, and the second heating wire 12 would be disposed vertically.

The electrical sensor and driver 13 is electrically coupled with the controller 24 and the compressor 23. The controller 24 can generate a control signal for operation modes of the compressor 23. In the case that the electrical sensor and driver 13 determines that the control signal is a high voltage signal, a start signal would be generated and then forwarded to the compressor 23 so as to start up the compressor 23. On the other hand, in the case that the electrical sensor and driver 13 determines that the control signal is a low voltage signal, a stop signal would be generated and then also forwarded to the compressor 23 so as to stop the compressor 23, i.e., Step S100 as follows. Since moisture condensation, as dew or fog, is always happened to the refrigeration storage apparatus 2 at a cooling operation, upon when the compressor 23 is definitely running, so the electrical sensor and driver 13 for detecting the control signals of the controller 24 can understand in advance the follow-up operation of the compressor 23. When the control signal of the controller 24 is a low voltage signal, it implies that the cooling operation of the compressor 23 is going to end, and thus the moisture condensing would be ended. At this time, the electrical sensor and driver 13 would generate a stop signal, accordingly.

In the art, the control signal of the controller 24 would be sent to the compressor 23 directly. When the control signal is a high voltage signal, the compressor 23 would be started, On the other hand, when the control signal is a low voltage signal, the compressor 23 would be stopped. In this present invention, the control signal is transmitted to the electrical sensor and driver 13 for the electrical sensor and driver 13 to determine whether the control signal is a high voltage signal or a low voltage signal. Thereupon, the follow-up operation of the defogging control system 1 can be determined. Also, the compressor 23 is started or stopped according to the control signal for the compressor 23.

The timer 14 is electrically coupled with the electrical sensor and driver 13. When the timer 14 receives the start signal, detection of a real-time operation time of the compressor 23 would be started. When the timer 14 receives the stop signal, the detection of the real-time operation time would be stopped, and further the detected real-time operation time would be defined and recorded as the preceding operation time (i.e., Step S200). In the present invention, the timer 14 can be a clock generator, a time meter, a time chip and any device or element that can be used to detect the time.

The environment sensing module 15 is used for detecting an ambient temperature and an ambient humidity of the refrigeration storage apparatus 2 (i.e., Step S200). The environment sensing module 15 can include a thermometer, a hygrometer and any device that can be used to detect the temperature and the humidity.

The control module 16, electrically coupled with the environment sensing module 15, the electrical sensor and driver 13, the timer 14, the first heating wires 11 and the second heating wires 12, is used for receiving the ambient temperature, the ambient humidity, the real-time operation time and the preceding operation time. In addition, Upon receiving the start signals, the control module 16 controls respectively the first heating wires 11 to activate at a first power since a first working time start point and the second heating wires 12 to activate at a second power since a second working time start point (i.e., Step S300). In this embodiment, the first power is greater than the second power. In the present invention, the control module 16 can be a micro controller (MCU), a processor, a control chip or any device that can perform the desired controls.

The first heating wire 11 and the second heating wire 12 can be the same kind of electric heating wires but with different lengths so as to present the first power greater than the second power. However, the first heating wire 11 and the second heating wire 12 can be different kinds of electric heating wires so as to make the first power greater than the second power. Nevertheless, no matter whether or not the first heating wire 11 and the second heating wire 12 are the same kind of the electric heating wires, the most essential demand for the heating wires of the present invention is that the first power of the first heating wire 11 must be greater than the second power of the second heating wire 12.

In this embodiment, the control module 16 includes a first control unit 161 and a second control unit 162; in which the first control unit 161 is used for controlling the first heating wires 11, and the second control unit 162 is used for controlling the second heating wires 12. Preferably, the first control unit 161 and the second control unit 162 are operated synchronously but independently.

The first control unit 161 would firstly calculate a product of the ambient humidity and the preceding operation time, and the product is defined as a first working time. Then, a first time difference is obtained by subtracting the first working time from the preceding operation time (i.e., Step S301). Finally, it is determined whether or not the real-time operation time is greater than the first time difference (i.e., Step S302). When the first control unit 161 determines that the real-time operation time is greater than the first time difference, the first working time start point is defined, and the first heating wire 11 is activated (i.e., Step S303).

For example, given that the preceding operation time is 10 minutes and the ambient humidity is 70%, then the first working time would be 7 minutes by the first control unit 161, and thus the first time difference is 3 minutes. In this example, the 3-minute first time difference can be treated as an off time for the first heating wire 11. If the real-time operation time does not exceed the 3-minute first time difference, the first control unit 161 would keep an off state. On the other hand, as soon as the real-time operation time exceeds the 3-minute first time difference, the off time is ended, and thus the first control unit 161 would activate the first heating wire 11.

The reason for the first control unit 161 to define the first working time as the product of the preceding operation time and thee ambient humidity is due to the moisture condensation, which is related to the ambient humidity. The greater the ambient humidity, the higher the possibility of moisture condensation is. Hence, in the present invention, the product of the preceding operation time and the ambient humidity is used for determining the first working time. As the ambient humidity goes higher, the first working time is closer to the preceding operation time. If the ambient humidity is low, a larger difference would exist between the first working time and the preceding operation time, and therefrom energy can be substantially saved.

The second control unit 162 would firstly use the ambient temperature and the ambient humidity to derive a corresponding dew point temperature, and then calculate a temperature difference between the ambient temperature and the dew point temperature (i.e., Step S305). Further, the second control unit 162 would determine whether or not an absolute value of the temperature difference is smaller than a threshold value (i.e., Step S306). In the art, the dew point temperature has a definite definition in physics, and thus details thereabout are omitted herein.

If the second control unit 162 determines that the absolute value of the temperature difference is smaller than the threshold value, it implies that the difference between the ambient temperature and the dew point temperature is extremely small, and thus the possibility of moisture condensation is high. Thereupon, the second control unit 162 would define directly the aforesaid second working time start point and activate the second heating wires 12 (i.e., Step S307). In this embodiment, the threshold value can be a preset value such as 3, 5, 6 or another number, and is mainly determined according to the ambient temperature and humidity.

When the second control unit 162 determines that the absolute value of the temperature difference is not less than the threshold value, the second control unit 162 would react similarly to the first control unit 161. That is, the second control unit 162 would firstly compute the product of the ambient humidity and the preceding operation time, and further define this product as a second working time. Then, a second time difference is derived by subtracting the second working time from the preceding operation time (i.e., Step S308). Finally, it is determined whether or not the real-time operation time is greater than the second time difference (i.e., Step S309). If the second control unit 162 determines that the real-time operation time is greater than the second time difference, then the aforesaid second working time start point is defined, and also the second heating wires 12 are activated (i.e., Step S310). Basically, the first working time is equal to the second working time.

Generally, the moisture condensation can mostly happen to the refrigeration storage apparatus 2 under the cooling operation, and at this stage the compressor 23 must be in a running state. Hence, upon when the electrical sensor and driver 13 detects that the compressor 23 is in a stop state, a stop signal would be generated. As long as the first control unit 161 and the second control unit 162 of the control module 16 receive the stop signal, the first heating wires 11 and the second heating wires 12 are directly deactivated (i.e., Step S304 and Step S311). In comparison to the conventional device whose heating wires are on all day long, energy consumption of the present invention is substantially reduced, for the first heating wires 11 and the second heating wires 12 are off while the compressor 23 is in the stop state. In the present invention, it shall be explained that, whenever the control module 16 receives the stop signal, the first heating wires 11 and the second heating wires 12 are immediately deactivated.

Further, the electric heating wires in this embodiment are divided into two kinds of electric heating wires with different powers. According to different criteria and environmental conditions, the system and method of the present invention can activate only the second heating wires 12 with lower powers and less energy consumption, or both the first heating wires 11 and the second heating wire 12. Therefore, in comparison with the conventional design whose electric heating wires are always activated, the system and method provided by this invention can have at least a benefit of saving the electricity. In addition, since the timing for activating the second heating wires 12 is related to the dew point temperature, thus, besides saving the energy, the system and method of the present invention can also prevent the refrigeration storage apparatus 2 from the moisture condensation on the main casing 21, the door 22 or the transparent glass 221.

The aforesaid description upon the preferred system of the present invention is not particularly used for limiting the scope of the present invention. For example, after receiving the ambient temperature, the ambient humidity, the real-time operation time and the preceding operation time, the control module 16 can compute the corresponding heat, energy, entropy and depreciation, and further control accordingly the first heating wires 11 and the second heating wires 12. In another example, the control module 16 can have a built-in check table for illustrating the relationship among the ambient temperature, the ambient humidity, the real-time operation time, the preceding operation time, the first working time start point and the second working time start point. If the relationship is not provided, then an interpolation method can be applied for further evaluation.

Figure 5:
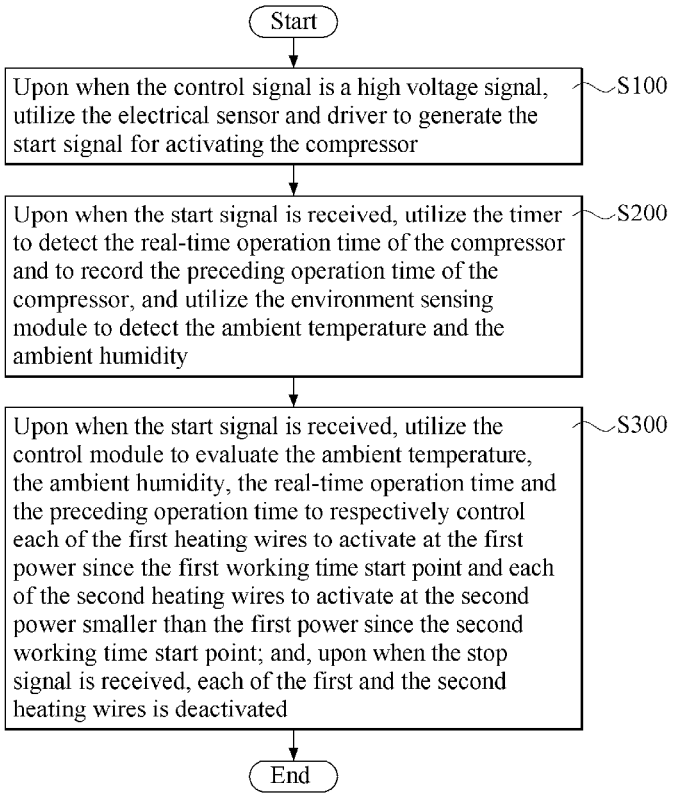
FIG. 5 is a flowchart of a preferred embodiment of the defogging control method in accordance with the present invention.
Figure 6:
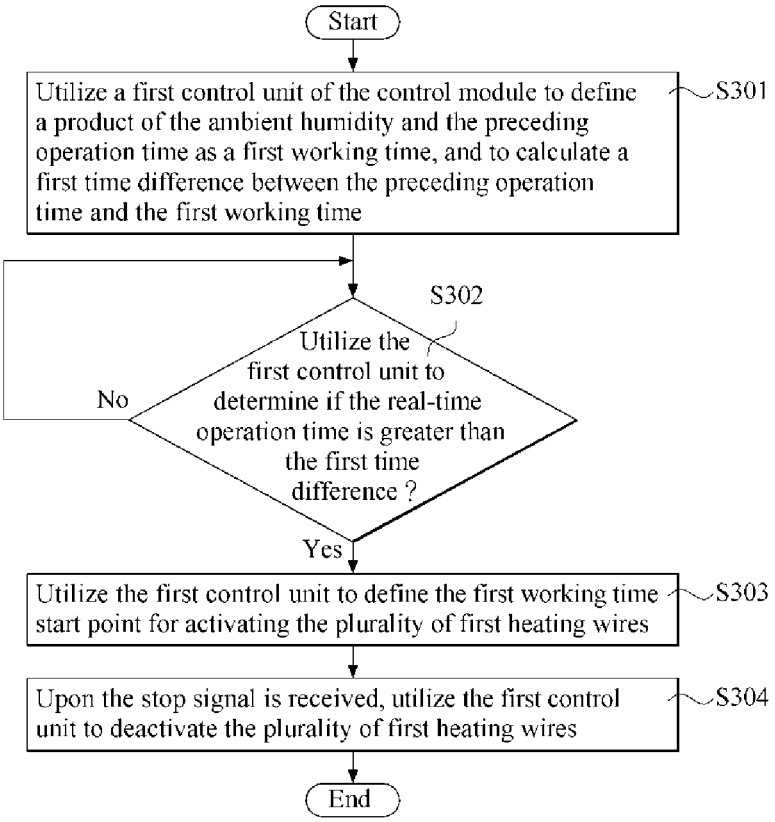
FIG. 6 shows detail steps for Step S300 of FIG. 5.
Figure 7A:
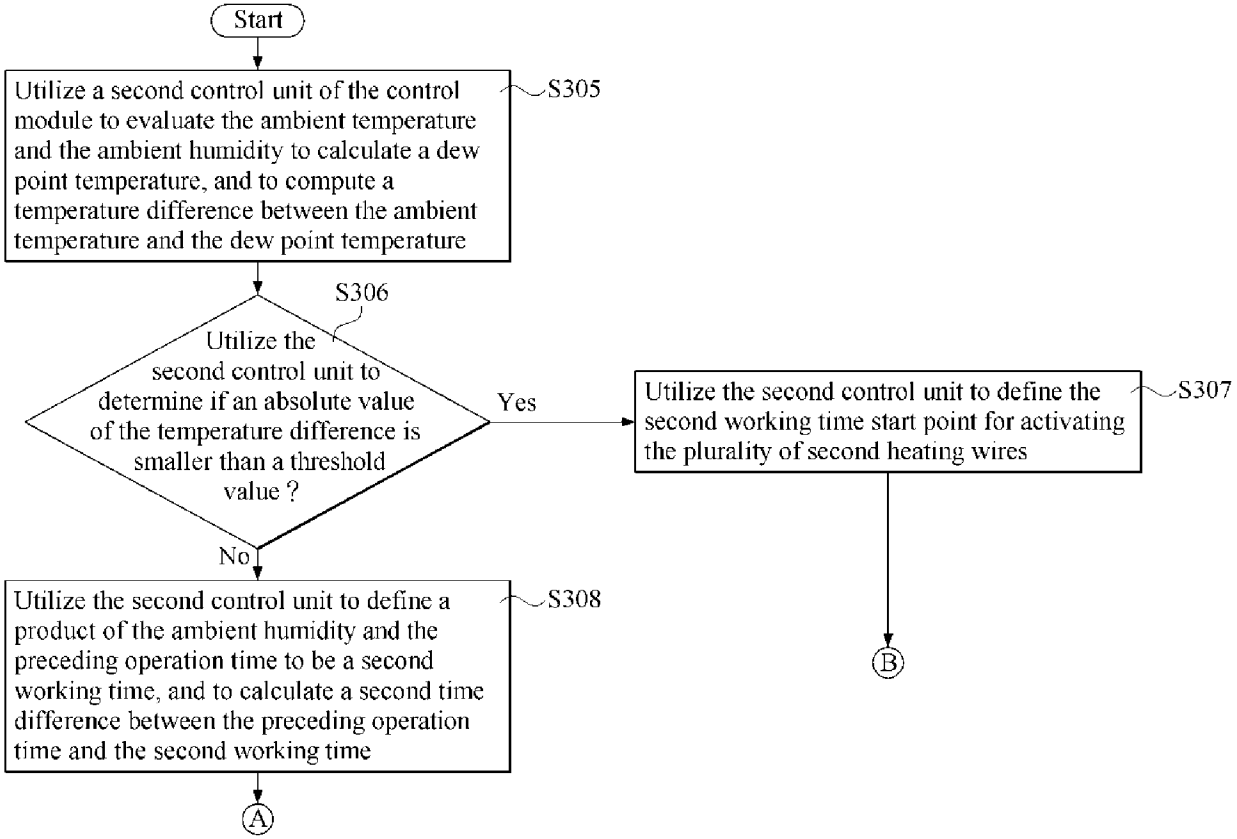
FIG. 7A and FIG. 7B show together another detail steps for Step S300 of FIG. 5.
Figure 7B:
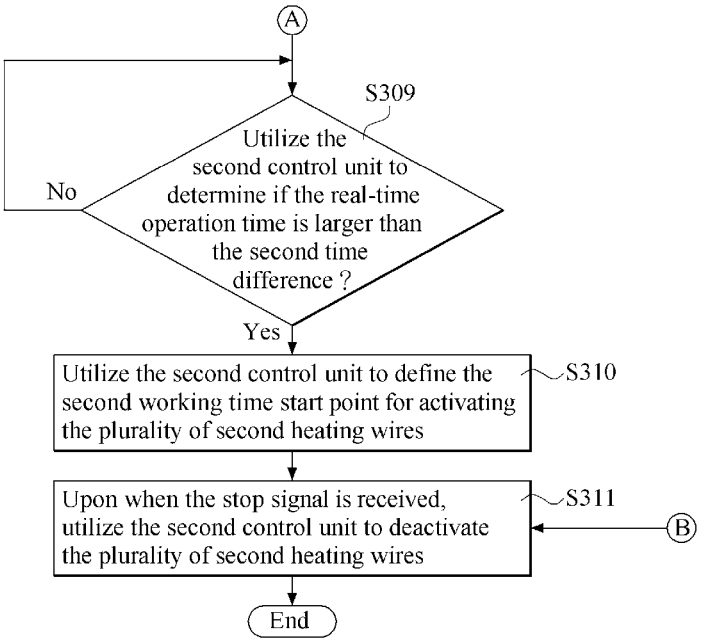

Then, refer also to FIG. 5 through FIG. 7B; where FIG. 5 is a flowchart of a preferred embodiment of the defogging control method in accordance with the present invention, FIG. 6 shows detail steps for Step S300 of FIG. 5, and FIG. 7A and FIG. 7B show together another detail steps for Step S300 of FIG. 5. As shown, the defogging control method, applied to the defogging control system 1 of FIG. 4, includes the following steps.

Step S100: The electrical sensor and driver is applied. If the electrical sensor and driver determines that the control signal is a high voltage signal, the a start signal is generated to activate the compressor.

Step S200: The timer is applied. Upon receiving the start signal, detect the real-time operation time of the compressor, and record the preceding operation time of the compressor. In addition, the environment sensing module is used to detect the ambient temperature and the ambient humidity.

Step S300: The control module is applied. Upon receiving the start signal, evaluate the ambient temperature, the ambient humidity, the real-time operation time and the preceding operation time to respectively control each of the first heating wires to activate at the first power since the first working time start point and each of the second heating wires to activate at the second power (less than the first power) since the second working time start point. As soon as the stop signal is received, then both the first heating wires and second heating wires are deactivated.

In Step S300, the control module is applied. Upon receiving the start signal, the method for evaluating the ambient temperature, the ambient humidity, the real-time operation time and the preceding operation time to control each of the first heating wires to activate at the first power since the first working time start point can further include the following steps.

Step S301: A first control unit of the control module is applied. A product of the ambient humidity and the preceding operation time is defined as a first working time, and a first time difference between the preceding operation time and the first working time is calculated.

Step S302: The first control unit is utilized to determine whether or not the real-time operation time is greater than the first time difference.

Step S303: The first control unit is utilized to define the first working time start point for activating the first heating wires.

Step S304: The first control unit is applied. Upon receiving the stop signal, the first heating wires are deactivated.

In Step S300, the control module is applied. Upon receiving the start signal, the method for evaluating the ambient temperature, the ambient humidity, the real-time operation time and the preceding operation time to control each of the second heating wires to activate at the second power, less than the first power, since the second working time start point can further include the following steps.

Step S305: A second control unit of the control module is applied. The ambient temperature and the ambient humidity are evaluated to derive a dew point temperature, and a temperature difference between the ambient temperature and the dew point temperature is calculated.

Step S306: The second control unit is utilized to determine whether or not the absolute value of the temperature difference is smaller than a threshold value.

Step S307: The second control unit is introduced to define the second working time start point for activating the second heating wires.

Step S308: The second control unit is applied to define a product of the ambient humidity and the preceding operation time as a second working time, and to calculate a second time difference between the preceding operation time and the second working time.

Step S309: The second control unit is introduced to determine whether or not the real-time operation time is greater than the second time difference.

Step S310: The second control unit is used to define the second working time start point for activating the second heating wires.

Step S311: The second control unit is applied. Upon receiving the stop signal, the second heating wires are deactivated.

Some other details of Steps S100-S300 and Steps S301-S311 are elucidated in the foregoing description, and thus omitted herein.

In summary, the electric heating wires provided by the present invention are deactivated as the compressor is stopped. While the compressor is at work, the control of the electric heating wires depends on the ambient temperature, the ambient humidity, the real-time operation time and the preceding operation time. Further, in this present invention, two kinds of the electric heating wires with different powers are provided to be controlled individually according to the ambient temperature, the ambient humidity, the real-time operation time and the preceding operation time. In comparison with the prior art that provides one single type of electric heating wires to be activated all the time, the system and method of the present invention can reduce the energy consumption, and also prevent the refrigeration storage apparatus from moisture condensation.

While the present invention has been particularly shown and described with reference to a preferred embodiment, it will be understood by those skilled in the art that various changes in form and detail may be without departing from the spirit and scope of the present invention.

What is claimed is:

1. A defogging control system, disposed at a refrigeration storage apparatus, the refrigeration storage apparatus including a controller, a compressor, a main casing and a door, the defogging control system comprising:

a plurality of first heating wires, disposed on the main casing by facing the door;

a plurality of second heating wires, disposed on the main casing by facing the door and located with respect to the plurality of first heating wires;

an electrical sensor and driver, electrically coupled with the controller and the compressor, configured for determining whether a control signal generated by the controller is a high voltage signal or a low voltage signal, generating a start signal for activating the compressor when the control signal is determined to be the high voltage signal, generating a stop signal for deactivating the compressor when the control signal is determined to be the low voltage signal;

a timer, electrically coupled with the electrical sensor and driver, used for detecting a real-time operation time of the compressor when the start signal is received, and for recording a preceding operation time of the compressor;

an environment sensing module, configured for detecting an ambient temperature and an ambient humidity; and a control module, electrically coupled with the environment sensing module, the electrical sensor and driver and the timer, used for receiving the ambient temperature, the ambient humidity, the real-time operation time and the preceding operation time, controlling respectively each of the plurality of first heating wires to activate at a first power since a first working time start point and each of the plurality of second heating wires to activate at a second power since a second working time start point when the start signal is received, so that the refrigeration storage apparatus is prevented from moisture condensation;

wherein the first power is greater than the second power; and when the control module receives the stop signal, the plurality of first heating wires and the plurality of second heating wires are deactivated;

wherein the control module is configured for defining a product of the ambient humidity and the preceding operation time to be a first working time, calculating a first time difference between the preceding operation time and the first working time, and defining the first working time start point for activating the plurality of first heating wires when the real-time operation time is determined to be greater than the first time difference.

2. The defogging control system of claim 1, wherein when the control module receives the stop signal, each of the plurality of first heating wires is deactivated.

3. The defogging control system of claim 1, wherein the control module is further configured for evaluating the ambient temperature and the ambient humidity to calculate a dew point temperature, deriving a temperature difference between the ambient temperature and the dew point temperature, and defining the second working time start point for activating the plurality of second heating wires when an absolute value of the temperature difference is determined to be smaller than a threshold value.

4. The defogging control system of claim 3, wherein the control module is further configured for defining a product of the ambient humidity and the preceding operation time to be a second working time, calculating a second time difference between the preceding operation time and the second working time, and calculating the second working time start point for activating the plurality of second heating wires when the absolute value of the temperature difference is greater than or equal to the threshold value and the real-time operation time is greater than the second time difference.

5. The defogging control system of claim 4, wherein when the control module receives the stop signal, each of the plurality of second heating wires is deactivated.

6. The defogging control system of claim 1, wherein each of the plurality of first heating wires extends vertically by being embedded in the main casing, and each of the plurality of second heating wires extends horizontally by being embedded in the main casing.

7. The defogging control system of claim 1, wherein each of the plurality of first heating wires has a first length, each of the plurality of second heating wires has a second length, and the first length is greater than the second length.

8. The defogging control system of claim 1, wherein the main casing has a plurality of longer sides and a plurality of shorter sides, each of the plurality of first heating wires extends along one of the plurality of longer sides, and each of the plurality of second heating wires extends along one of the plurality of shorter sides.

9. A defogging control method, applied to the defogging control system of claim 1, comprising the steps of:

(a) when the control signal is determined to be the high voltage signal, utilizing the electrical sensor and driver to generate the start signal for activating the compressor;

(b) when the start signal is received, utilizing the timer to detect the real-time operation time of the compressor and to record the preceding operation time of the compressor, and utilizing the environment sensing module to detect the ambient temperature and the ambient humidity; and (c) when the start signal is received, utilizing the control module to evaluate the ambient temperature, the ambient humidity, the real-time operation time and the preceding operation time to respectively control each of the plurality of first heating wires to activate at the first power since the first working time start point and each of the plurality of second heating wires to activate at the second power smaller than the first power since the second working time start point; and (d) when the stop signal is received, each of the plurality of first heating wires and the plurality of second heating wires is deactivated; further including the steps of:

(d1) utilizing the control module to define a product of the ambient humidity and the preceding operation time to be a first working time, and to calculate a first time difference between the preceding operation time and the first working time;

(d2) when the real-time operation time is greater than the first time difference, utilizing the control module to define the first working time start point for activating the plurality of first heating wires; and (d3) when the stop signal is received, utilizing the control module to deactivate the plurality of first heating wires.

10. The defogging control method of claim 9, wherein the Step (d) further includes the steps of:

(d4) utilizing the control module to evaluate the ambient temperature and the ambient humidity to calculate a dew point temperature, and to compute a temperature difference between the ambient temperature and the dew point temperature;

(d5) utilizing the control module to determine whether or not an absolute value of the temperature difference is smaller than a threshold value;

(d6) if a determination of the Step (d5) is positive, utilizing the second control unit to define the second working time start point for activating the plurality of second heating wires;

(d7) if the determination of the Step (d5) is negative, utilizing the control module to define a product of the ambient humidity and the preceding operation time to be a second working time, and to calculate a second time difference between the preceding operation time and the second working time;

(d8) when the real-time operation time is determined to be greater than the second time difference, utilizing the control module to define the second working time start point for activating the plurality of second heating wires; and (d9) after one of the Step (d6) and the Step (d8), when the stop signal is received, utilizing the control module to deactivate the plurality of second heating wires.

* * * * *